United States Patent [19]

Demartini

[11] Patent Number: 4,796,390

[45] Date of Patent: Jan. 10, 1989

[54] RAIN GUTTER DEVICES

[76] Inventor: Robert J. Demartini, 3500 Canter La., Raleigh, N.C. 27604

[21] Appl. No.: 119,683

[22] Filed: Nov. 12, 1987

[51] Int. Cl.[4] ..... E04D 13/04

[52] U.S. Cl. ..... 52/12; 52/96; 248/48.1

[58] Field of Search ..... 52/11–16, 52/94–96, 97, 573, 548; 210/162, 474; 248/48.1, 48.2

[56] References Cited

U.S. PATENT DOCUMENTS

| | | | |
|---|---|---|---|
| 891,406 | 6/1908 | Cassens | 248/48.2 |
| 2,144,663 | 1/1939 | Petersen | 248/48.1 |
| 2,636,458 | 4/1953 | Harris | 210/474 |
| 3,420,378 | 1/1969 | Turner | 52/12 |
| 4,254,595 | 3/1981 | Crosslen | 248/48.1 |
| 4,404,775 | 9/1983 | Demartini | 52/12 |
| 4,497,146 | 2/1985 | Demartini | 52/12 |

*Primary Examiner*—James L. Ridgill, Jr.

*Attorney, Agent, or Firm*—William G. Rhines

[57] ABSTRACT

This invention relates to rain gutter devices, and in one embodiment comprises a bracket for use in supporting a rain-water deflector. The bracket is in the form of a flat continuum having a straight upper section and a double-reverse lower section. The lowermost portion includes a tab adapted for receiving the top edge of an associated rain-gutter. The upper section includes tabs for insertion into corresponding apertures in associated rain-water deflectors. Other embodiments include such brackets in combination with rain-water deflectors having bracket tab apertures, each of which consists of a central opening and side-openings that are separated from their associated central opening by a narrow web. Thereby, upon movement of the rain-water shield in its long dimension as a result of thermal expansion and contraction, the associated bracket tabs will break through the webs, eliminating restraint on migration of the shields and avoiding buckling of the rain-water shield.

8 Claims, 1 Drawing Sheet

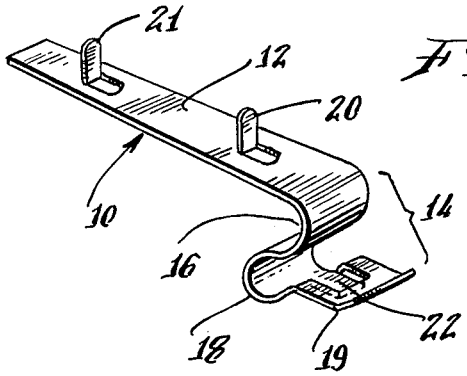
Fig. 1.
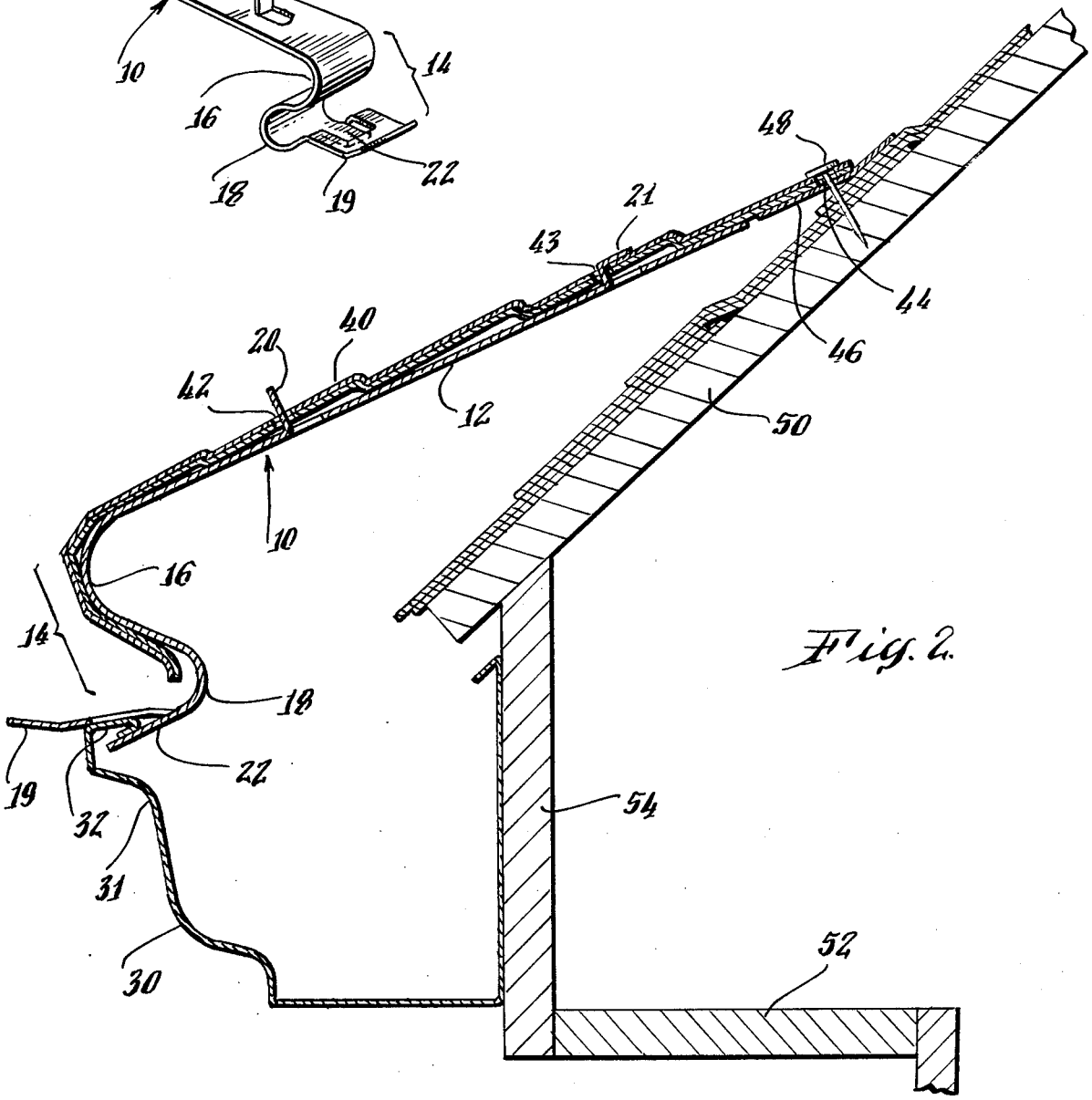
Fig. 2.
Fig. 3A
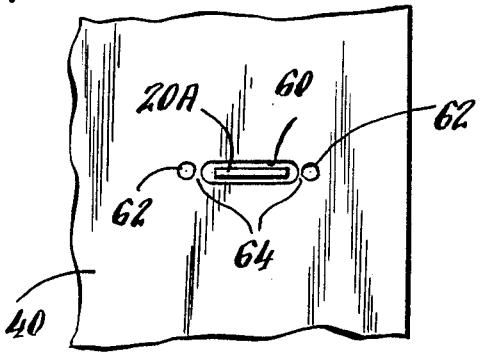
Fig. 3B.
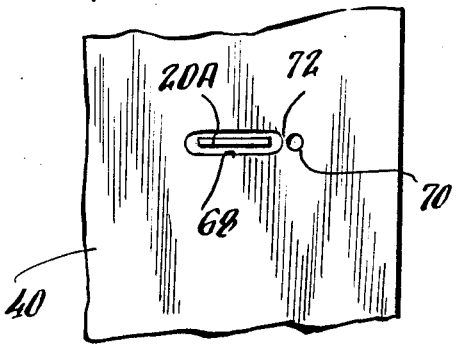

RAIN GUTTER DEVICES

BACKGROUND OF THE INVENTION

In my U.S. Pat. No. 4,404,775, which issued on Sept. 20, 1983 I disclosed new and novel rain-water deflector devices. Such devices utilize surface tension to overcome other forces acting upon rain-water falling down the surface of a roof, to cause the rain-water to be deflected into the associated gutter while leaves, pine-needles, sticks, and other debris borne by the water are jettisoned away from the gutter. As a result, clogging of the rain gutters is avoided and it is unnecessary to clean them out manually. Devices embodying that patent, which are currently being marketed commercially under the trademark "Gutter Helmet", have proved successful. However, considerable effort has been expended on means for mounting such deflectors that will be efficacious, inexpensive, and easy and quick to install, but, at the same time, will not introduce other difficulties. For example, it was clear from the outset that such deflectors would have to be anchored securely against wind, rain and other forces. However, simply screwing the outermost end of the deflector bracket to the outer lip of an associated gutter presented several difficulties. Whether being so installed by one working from the roof (a usual situation) or by one working from beside the gutter, even if the lowest end of a bracket were pre-drilled to receive a screw extending through the gutter lip and into the bracket, the work had to be done essentially "blind" because visibility of the bracket end is blocked by the gutter edge. Such practices are not only tedious in requiring that the various alignments be made "blind" but are also dangerous, particularly to one working from the roof and having to reach out over the edge to set screws and to make drill holes through the gutter lip and the bracket end. Further, the rain-water deflector is in close proximity to virtually the entire gutter-roof edge area. This provides little space in which to work and severely restricts the available light and visibility of the worksites. Further, disturbance of existing structures is undesirable, as by dis-assembly to any extent of the existing gutter structures in order to get access to the existing gutter brackets. In addition, such procedures may be too intricate or extensive for home-owners or other non-skilled tradesmen who may be involved in rain-water deflectors as a "retro-fit" of existing gutter systems. In this connection, reference is made to my U.S. Pat. No. 4,497,146 which issued on 2/5/85 and the references cited therein. Accordingly, it is an object of this invention to provide means for the installation of rain-water deflectors.

Another object of this invention is to provide such means in a form which will be easy to utilize with existing gutter systems.

Yet another object of this invention is to provide means for achieving the foregoing objectives which will not require substantial reconstruction of existing gutter systems.

Still another object of this invention is to provide means for achieving the foregoing objectives which will also accomodate the physical changes which may occur after installation, such as thermal expansion and construction.

SUMMARY OF INVENTION

Desired objectives may be achieved through practice of the present invention, embodiments of which include a rain-water gutter deflector bracket having a substantially straight upper section and a reverse-curved, downward oriented lower section, including upward facing tab means in the upper section to be received in corresponding apertures in an associated deflector, and downward facing tab means in the lower section to receive the upper edge of an associated rain gutter. Other embodiments include such bracket devices in combination with associated deflector devices wherein the deflector has apertures for receiving the tabs in the upper portion of the bracket that are separated from other holes at one or both sides by means of a thin web through which the associated bracket tab will break upon linear migration of the deflector due to temperature change.

DESCRIPTION OF DRAWINGS

This invention may be understood from the description which follows and from the accompanying drawings in which FIG. 1 depicts a perspective view of a bracket embodying this invention, FIG. 2 depicts a cross-sectional view of the embodiment of this invention shown in FIG. 1 in use on a rain gutter with an associated rain-water deflector, and FIGS. 3A and 3B depict rain-water tab hole configurations useful in the practice of the present invention.

DESCRIPTION OF PREFERRED EMBODIMENTS

Referring first to FIG. #1, there is depicted a bracket 10 which embodies the present invention. As shown it is in the form of a flat continuum preferably made from metal which is strong, durable, weather-resistant, easily formed, and substantially rigid, yet susceptible to some bending without breakage. Heavy gauge aluminum has been found suitable for such use, but it is within the contemplation of this invention that other materials, such as galvanized steel, copper or cuprous alloys, or even plastic might also be utilized. It is also within the contemplation of this invention that even though a substantially parallel-sided flat continuum is shown and discussed, other cross-sectional shapes for the basic bracket stock might also be utilized, provided they accomodate substantially the physical displacements and affixation means herein disclosed or their effective equivalents.

As shown in FIGS. 1 and 2, the bracket 10 has an upper portion 12 which is substantially straight or at most slightly convexly curved. As shown in FIG. 2, it is designed for its upper end to be located in proximity to or even to rest on an associated roof 50, while it supports an associated rain-water deflector 40 and has its lower end supported by the upper edge 32 of an associated rain gutter 30.

FIGS. 1 and 2 also illustrate the lower portion 14 of the bracket 10, which has a reverse-direction upper curve 16, and a second reverse direction lower curve 18, the lowest end 19 of which is adapted to rest on the upper edge 32 of the outside wall 31 of the gutter 32. The upper portion 12 of the bracket 10 includes tabs 20, 21, which are punched out of the bracket stock so that they are at substantially right angles to the upper surface of the upper portion 12. This facilitates insertion of the tabs 42, 43 through corresponding tab apertures in the rain-water deflector to be positioned atop the bracket. Following such insertion, the tabs may be bent over with a wrench or other tool to hold the deflector affixed to the bracket. The effects of this latter sequence may be seen by comparing, in FIG. #2, the position of tab 20 (which is shown before being bent) with that of tab 21 (which is shown after having been bent). The lower portion 14 of the bracket 10 has a tab 22 punched out of its basic stock, but the orientation of this tab with respect to the surface of the bracket is substantially V-shaped. Thereby, the free end of the tab 22 and the undersurface of the bracket gutter rest portion 19 form an open-ended receptacle into which the upper edge 32 of the associated gutter 30 may be received for positionally fixing the bracket with respect to the gutter.

As shown in FIG. 2, this invention may be used in connection with standard, existing building construction wherein a gutter 30 is affixed to the fascia 54 next to a soffit 52, in the area where the roof 50 overhangs the fascia. The bracket is positioned with the top edge 32 of the gutter 30 inserted into the opening formed by the divergence of the tab 22 from the lowermost end region 19 of the bracket 10. When so positioned, the entire reverse curved lower portion 14 of the bracket 10 elevates the lower end of the straight portion 12 of the bracket 10, with the higher reverse curved portion 16 acting as a support for the underside of the "nose" of the deflector 40. In that position, the bracket and the deflector which it supports are positioned well above the edge of the roof 50, while the uppermost end of the straight portion 12 of the bracket extends some distance back from the edge of the roof. The effect of this is to cause a rain-water deflector of the type shown in my abovementioned patent, when positioned atop the bracket, to present a more gentle or shallower slope to water coming off the roof. It also supplies a support base for the associated deflector 40 while providing sufficient spacing of the deflector above the gutter edge to permit the deflector to function as intended. Thus, the deflector is positioned to deflect water into the gutter while jettisoning any leaves and other debris that are carried along by the water off of its curved surface 16 and outside the front wall 31 of the gutter 30. Any such leaves and/or debris that are not so jettisoned by the water will merely accumulate on the deflector top surface, to be blown away by the wind after subsequent drying. By either process, the leaves and other debris will effectively have been kept from falling into the gutter. With several other brackets similarly installed and positioned at approximately five foot intervals along the length of the gutter at locations corresponding to the position of tab aperatures in the associated deflector, the deflector may then be positioned atop the brackets. Although the top ends of the brackets may be in contact with the roof (for example, where the panel has been cut back for aesthetic reasons, so as to extend less far up a steep roof), the deflector panels preferably extend above the upper ends of the support brackets, so that the under-side of the upper edge of the deflector panels come into contact with the upper surface of the associated roof. By this means, through use of an adhesive coated sealing strip 46 on the underside of the top edge of the deflector, that edge may be pressed against the roof surface following removal of a protective cover to produce an upper seal to inhibit water coming down the roof against passing under the deflector edge. The upper edge of the deflector panels may also include nail apertures 44 through which nails 48 may be loosely driven so as to anchor the upper edge of the strip against radical displacement while still permitting the deflector panels to move laterally as the deflectors expand or contract in response to temperature changes.

Another aspect of the present invention is illustrated in FIG. 3A and 3B, showing unique structural features in the formation of receptacle holes to receive tabs and/or roof nails of the type and for such purposes as those described above. FIG. 3A shows one embodiment of such structures comprising a central tab aperture 60 that extends through the deflector sheet, corresponding to those shown as 42, 43 in FIG. 2. The central hole 60 preferably is oblong, with its longer axis oriented in the direction of the long dimension of the deflector 40. As such, it is particularly adapted to receive a tab 20A which is longer in cross-section in that same dimension when deflector panels and their associated support bracket are in situ. On either side of the central hole 60 in that same long dimension, and separated therefrom by thin webs of metal 64 that are left from the original sheet stock from which the deflector panels are formed, are smaller side holes 62. When a deflector panel is positioned atop brackets as herein disclosed with a bracket tab 66 positioned in central hole 60, as noted above, the tab may be bent over, using a wrench or simple slotted tool in order to hold the deflector panel in place atop the deflector against movement induced by wind, water, or other forces. Subsequently, if sunlight hitting the panel, or a raise in ambient temperature, or other change causes the temperature of a deflector panel to rise, consequent expansion of the panel may cause a net linear displacement of the deflector panel in the direction of its long dimension at any given bracket tab affixation location. In that event, this unique structural feature will permit the associated tab to break through the web on one side and utilize the additional space provided by the side hole without the deflector panel being blocked from migrating by the tab, thereby avoiding the buckling of the panel that might otherwise occur. Conversely, if the temperature of the panel drops and the panel therefore contracts, any consequent net migration of the panel in the opposite direction is accomodated by the tab breaking the web into the other side hole, thereby avoiding buckling, tearing, or other adverse affect on the deflector panel. An advantage of the "central hole - two ancillary hole" configuration shown in FIG. 3A is that by making an installation initially with the support tabs in the central hole when the panel is at or near a median of the range of temperatures to which it will be exposed in the normal course, the adverse effects of both temperature increase and decrease can be avoided. Even if such care as to temperature condition is not taken at the time of installation, a single sidehold-web combination will usually provide sufficient relief to accomodate most situations. Thus, FIG. 3B illustrates an alternative configuration to demonstrate that although an elongated central hole is preferred, other configurations, such as the round hole shown in FIG. 3B, will also work, and that a single ancillary side hole may also be utilized. Thus, embodiments of this invention include brackets of the type disclosed in combination with deflector panels having bracket tab holes which include structural features of the type disclosed herein.

In practice, embodiments of this invention may be utilized in connection with the installation of rain gutter deflector panels in the foilowing manner. First, a mounting bracket of the type disclosed may be affixed to each end of a deflector panel by inserting the panel affixation tabs on the top of the bracket through the corresponding tab aperatures in the panel. Optionally, a seal strip may be adhesively fixed to the upper edge of the panel, to provide a means for securing the upper deflector panel edge to the shingles of the associated roof. The panel is then positioned in line with and over the gutter with which it is to be associated. The protective cover on the outside of the edge seal strip (if one has been used) may then be removed. Then, whether or not an edge seal strip has been used, the upper edge of the deflector may be laid on, or (preferably) slid under the edge of, a course of the roof shingles. The front end of each of the brackets may thus be positioned on the top edge or bead of the front wall of the associated gutter with the bead residing in the V-shaped slot formed by the lower end of each bracket and its lower tab. If more than one deflector panel is to be used (e.g., in order to extend the panels over a greater length along the edge of the roof), the next panel, but without a bracket affixed to its end that is next to the first panel, is positioned atop the end of the first panel to which it is to be join, with the upper tabs of the first panel bracket on that end extending through the tab apertures in the second panel. The upper tabs may then be bent over, using a wrench or other tool, and nails may be loosely driven into the roof through holes in the upper edge of the panels, thus affixing the panels in place.

It will be apparent from the foregoing that through use of the present invention, it is possible to make effective and durable installations of rain-water gutter deflectors without having to utilize screws or other such fasteners. It will also be clear that by aligning the brackets with the pre-formed tab apertures, the possibility of faulty installations is substantially reduced.

Although the present installation is shown and described in the context of its particular suitability to use with a gutter of the so-called "K" type which is herein illustrated, brackets according to this invention are also readily adaptable to use with gutters which are of other cross-sectional configurations, such as an upwardly opening half-round, and with wooden gutters. This may be accomplished by bending the tab 22 downward so that it is substantially at right angles to the lower portion 19 of the bracket, in which posture it may be held to the top of the outside wall of the associated gutter using, for example, a screw inserted through the gutter edge and the now bent-down tab 22.

It is to be understood that the embodiments of this invention herein shown and discussed are by way of illustration and not of limitation, and that other embodiments may be made without departing from the spirit and scope of this invention.

I claim:

1. A device for securing rain water gutter deflector apparatus to an associated building structure comprising an elongated continuous strip having a substantially straight upper portion and a double reverse-curved lower portion, said straight portion having upper attachment means integral therewith for affixing to said device a gutter deflector positioned at the top of said straight section and the upper-most curve of said double-reverse curved lower portion, the lowermost curve of said double-reversed portion including lower attachment means for affixing said device to an associated rain gutter in supported relationship thereto.

2. The device described in claim 1 wherein said upper attachment means comprises at least one upwardly oriented tab susceptible to being bent over so as to effect affixation of a rain water deflector to said device after each of said tabs have been inserted into apertures in said deflector.

3. The device described in claim 1 wherein said lower attachment means comprises a tab integral with the outermost end of said lowermost curve, wherein the underside of said end and the upper side of said tab form an open-ended receptacle for receipt therein of the upper lip of the outer wall of a rain gutter associated therewith.

4. The device described in claim 2 wherein said lower attachment means comprises a tab integral with the outermost end of said lowermost curve, wherein the underside of said end and the upperside of said tab form an open-ended receptacle for receipt therein of the upper lip of the outer wall of a rain gutter associated therewith.

5. A rain water gutter deflector system comprising a bracket with includes an elongated continuum having a substantially straight upper portion and a double reverse-curved lower portion, said straight portion having upper attachment means integral therewith for affixing to said device a gutter deflector positioned at the top of said straight section and the upper most curve of said double-reverse curved lower portion, the lowermost curve of said double-reversed portion including lower attachment means for affixing said device to an associated rain gutter in supported relationship thereto, and an elongated rain-water deflector having aperture means adapted to receive said upper attachment means of said bracket, said aperture means being characterized by the fact of including a central receptacle hole in said deflector and at least one associated side-hole that is separated from said central hole by a thin web and is so oriented with respect to said central hole as to be substantially in the direction of the long dimension of said deflectors .

6. The system described in claim 5 wherein said lower attachment means comprises a tab integral with the outermost end of said lowermost curve, wherein the underside of said end and the upper side of said tab form an open-ended receptacle for receipt therein of the upper lip of the outer wall of a rain gutter associated therewith.

7. The system described in claim 5 wherein said upper attachment means comprises at least one upwardly oriented tab susceptible to being bent over so as to effect affixation of a rain water deflector to said device after each of said tabs have been inserted into apertures in said deflector.

8. The system described in claim 7 wherein said lower attachment means comprises a tab integral with the outermost end of said lowermost curve, wherein the underside of said end and the upper side of said tab form an open-ended receptacle for receipt therein of the upper lip of the outer wall of a rain gutter associated therewith.

* * * * *